US006311526B1

(12) United States Patent
Frushtick

(10) Patent No.: US 6,311,526 B1
(45) Date of Patent: Nov. 6, 2001

(54) MODULAR U-TURN TUNNEL FINISHER

(75) Inventor: Jeffrey Neal Frushtick, Denver, NC (US)

(73) Assignee: Leonard Automatics, Inc., Denver, NC (US)

( * ) Notice: Subject to any disclaimer, the term of this patent is extended or adjusted under 35 U.S.C. 154(b) by 0 days.

(21) Appl. No.: 09/372,313

(22) Filed: Aug. 11, 1999

(51) Int. Cl.[7] ..... D06B 3/30

(52) U.S. Cl. ..... 68/5 C; 68/20; 34/209; 34/210; 223/51

(58) Field of Search ..... 68/5 C, 5 E, 20; 8/149.1, 149.3; 223/51; 34/87, 201, 203, 209, 210

(56) References Cited

U.S. PATENT DOCUMENTS 2,443,069 * 6/1948 Gayring .
3,513,669 * 5/1970 Nirenberg ..... 68/5 C (List continued on next page.)

FOREIGN PATENT DOCUMENTS

2059880 * 6/1972 (DE) ..... 68/5 C
1401503 * 7/1975 (GB) ..... 68/5 C

OTHER PUBLICATIONS

Colmac Industries, Inc., Your One and Only "U", magazine, publication date was prior to the date this application was filed, 1 page, publisher unknown.
Colmac Industries, Inc., The Colmac CTU Series is Not a U–Shaped Tunnel Finisher it is the U–Shaped Tunnel Finisher, magazine, publication date was prior to the date this application was filed, 1 page, publisher unknown.

(List continued on next page.)

*Primary Examiner*—Frankie L. Stinson
(74) *Attorney, Agent, or Firm*—Adams, Schwartz & Evans, P.A.

(57) ABSTRACT

An expandable tunnel garment finishing apparatus including a front module having an entrance for receiving garments on hangers for being conveyed through the apparatus, an initial treatment zone downstream from the entrance for treating the garments with steam and heat, a final treatment zone downstream from the initial treatment zone for treating the garments with hot air, and an exit downstream from the final treatment zone and adjacent the entrance through which the finished garments exit the finishing apparatus. The finishing apparatus also includes a rear module communicating with the front module for receiving garments conveyed therefrom. The rear module includes a heating apparatus for heating the garments, and a U-shaped intermediate treatment zone downstream from the initial treatment zone and upstream from the final treatment zone for receiving the garments from the initial treatment zone and for delivering the garments to the final treatment zone and the exit of the front module. The front and rear module are separable for receiving therebetween at least one expansion module having an expansion treatment zone cooperating with the initial, intermediate, and final treatment zones for providing the garment finishing apparatus with an extended total treatment zone sufficient to permit accelerated flow of the garments through the finishing apparatus while maintaining sufficient dwell time of the garments in the finishing apparatus to permit completed finishing at the accelerated rate of flow of the garments.

8 Claims, 2 Drawing Sheets

U.S. PATENT DOCUMENTS

| | | | | |
|---|---|---|---|---|
| 3,686,899 | * | 8/1972 | Rosenfiled et al. . | |
| 3,696,523 | * | 10/1972 | Beeley et al. . | |
| 3,732,628 | * | 5/1973 | Blevens et al. . | |
| 3,765,580 | * | 10/1973 | Wilsker et al. . | |
| 3,949,770 | * | 4/1976 | Noren . | |
| 4,070,876 | * | 1/1978 | Thompson et al. . | |
| 4,276,995 | * | 7/1981 | Jennewein . | |
| 4,300,367 | * | 11/1981 | Thorsen . | |
| 4,304,053 | * | 12/1981 | Kellerhas et al. . | |
| 4,391,602 | * | 7/1983 | Stichnoth et al. . | |
| 4,403,425 | * | 9/1983 | Mussiger . | |
| 5,018,371 | * | 5/1991 | Riba . | |
| 5,376,144 | * | 12/1994 | McClain et al. | 68/5 C |
| 5,459,301 | * | 10/1995 | Miller et al. . | |
| 5,516,012 | * | 5/1996 | Weigel . | |

OTHER PUBLICATIONS

Colmac Industries, Inc., Colmac Didn't Start a Revolution, We Created a Standard, magazine, publication date was prior to the date this application was filed, 1 page, publisher unknown.

Colmac Industries, Inc., On Jun. 2, 1997 at Clean '97 in Las Vegas, You Will See the Future in Tunnel Finishing at Booth# 3346, magazine, publication date was prior to this application was filed, 1 page, publisher unknown.

Colmac Industries, Inc., Some Things are so Extraordinary You Just Have to Stop and Look, magazine, publication date was prior to the date this application was filed, 1 page, publisher unknown.

Leonard Automatics, Inc., Vision Series from Leonard, brochure, publication date was prior to the date this application was filed, 1 page, publisher unknown.

Leonard Automatics, Inc., The Technology of Tunnel Finishing From Leonard, brochure, publication date was prior to the date of this application was filed, 1 page, publisher unknown.

Leonard Automatics, Inc., Vision Series U–Turn Tunnel Finisher From Leonard Automatics, brochure, publication date was prior to the date this application was filed, 1 page, publisher unknown.

Leonard Automatics, Inc., Vision Series Specifications, brochure, publication date was prior to the date this application was filed, 1 page, publisher unknown.

Leonard Automatics, Inc., Like Child's Play, magazine, publication date was prior to the date this application was filed, 1 page, publisher unknown.

* cited by examiner 10
15
20

10
15
25
20
4
4

10
15
25
25
20

MODULAR U-TURN TUNNEL FINISHER

TECHNICAL FIELD AND BACKGROUND OF THE INVENTION

This application relates to U.S. Provisional Patent Application Serial No. 60/096,589, filed on Aug. 14, 1998, and claims priority to that provisional application. This invention relates to a U-turn tunnel finisher designed for commercial and industrial garment laundering plants. The tunnel finishers are used to remove wrinkles which are set into the garments during the laundry process, particularly when laundering cotton or cotton blend fabrics. In many cases these finishers are also used to dry the garments after laundering.

In general, the garment finisher is used to process garments after they have been laundered. The garment is then placed on a hanger and placed on a conveyor which carries the garment through the finishing machine. The garment is first conditioned with live steam injection, then heated and agitated with hot air, raising the fabric temperature to about 260–280 degrees Fahrenheit. At this temperature the remaining moisture is evaporated from the fabric. This causes the fibers in the garment to return to their memory state, with the fibers in their natural, relaxed condition. The wrinkles in the garment "fall out", and the garment is returned to a relatively neat appearance suitable for uniform-type garments such as uniform shirts, pants and similar garments.

The efficiency of this process and the quality of the appearance of the garment after processing is dependent on the dwell time of the garment inside the machine. The garment must remain in the finisher for a length of time sufficient to permit the temperature of the garment to be raised to the correct temperature well above the evaporation point of water so that the remaining moisture in the garment is evaporated.

Dwell time must also be compatible with daily production needs. Laundries must purchase a finisher or finishers with capacity large enough to handle present production as well as production increases over a long period of time. Prior art U-turn finishers are manufactured in such manner that an increase in production can be obtained only by purchasing additional finishers.

Specifically, prior art finishers include in a single cabinet all of the functioning elements necessary to the operation of the finisher, including the heating source, blowers, electrical and heating controls, steam-injection zone, air plenum and exhaust hood. In the U-turn type of finisher, damp garments on a hanger enter and exit on the same end of the finisher, making a U-turn at the opposite end. In a straight-through finisher, damp garments on a hanger enter one end and pass in a straight line through the finisher, exiting the other end.

In accordance with the invention, applicant has invented a U-turn tunnel finisher which is easily expandable in increments at substantially less cost than purchasing complete additional finishers. This has been done by designing and placing the functions of the finisher in modules so that they can be separated when necessary with modules designed only to permit an increase in dwell time without the need for adding further heat exchangers, controls and the like. The modules that merely increase dwell time—the expansion modules—may be constructed in varying lengths as needed. The finisher can finish garments wet to dry, damp to dry, or dry to dry.

SUMMARY OF THE INVENTION

Therefore, it is an object of the invention to provide a U-turn tunnel finisher which is expandable to accommodate required increases in production.

It is another object of the invention to provide a U-turn tunnel finisher which is expandable to accommodate required increases in production.

It is another object of the invention to provide a tunnel finisher which includes one or more expansion modules varying in length which can be inserted between the original machine modules for increasing the dwell time of the garments in the tunnel finisher.

It is another object of the invention to provide a tunnel finisher which includes separable rear module and front modules which collectively contain all of the necessary functioning components of the finisher, whereby the rear and front modules, when separated, accommodate between them at least one expansion module which permits additional dwell time of the garments in the finisher.

These and other objects of the present invention are achieved in the preferred embodiments disclosed below by providing an expandable tunnel garment finishing apparatus that includes a front module having an entrance for receiving garments on hangers for being conveyed through the apparatus, an initial treatment zone downstream from the entrance for treating the garments with steam and heat, a final treatment zone downstream from the initial treatment zone for treating the garments with hot air, and an exit downstream from the final treatment zone and adjacent the entrance through which the finished garments exit the finishing apparatus. The finishing apparatus also includes a rear module communicating with the front module for receiving garments conveyed therefrom. The rear module includes a heating apparatus for heating the garments, and a U-shaped intermediate treatment zone downstream from the initial treatment zone and upstream from the final treatment zone for receiving the garments from the initial treatment zone and for delivering the garments to the final treatment zone and the exit of the front module. The front and rear module are separable for receiving therebetween at least one expansion module having an expansion treatment zone cooperating with the initial, intermediate, and final treatment zones for providing the garment finishing apparatus with an extended total treatment zone sufficient to permit accelerated flow of the garments through the finishing apparatus while maintaining sufficient dwell time of the garments in the finishing apparatus to permit completed finishing at the accelerated rate of flow of the garments.

According to one preferred embodiment of the invention, the finishing apparatus includes one expansion module positioned intermediate the front module and the rear module for providing the garment finishing apparatus with an extended total treatment zone sufficient to permit accelerated flow of the garments through the finishing apparatus while maintaining sufficient dwell time of the garments in the finishing apparatus to permit completed finishing at the accelerated rate of flow of the garments.

According to another preferred embodiment of the invention, the finishing apparatus has a total length of 288 inches.

According to yet another preferred embodiment of the invention, the heating apparatus has a burner rating of 800,000 BTU.

According to yet another preferred embodiment of the invention, the finishing apparatus includes two adjacent, detachably connected expansion modules positioned intermediate the front module and the rear module to further extend the total treatment zone for maximum accelerated flow of the garments through the finishing apparatus while maintaining sufficient dwell time of the garments in the finishing apparatus to permit completed finishing at the maximum rate of flow of the garments.

According to yet another preferred embodiment of the invention, the finishing apparatus has a total length of 384 inches.

According to yet another preferred embodiment of the invention, the heating apparatus has a burner rating of 1,200,000 BTU.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figures 1, 2, 3:
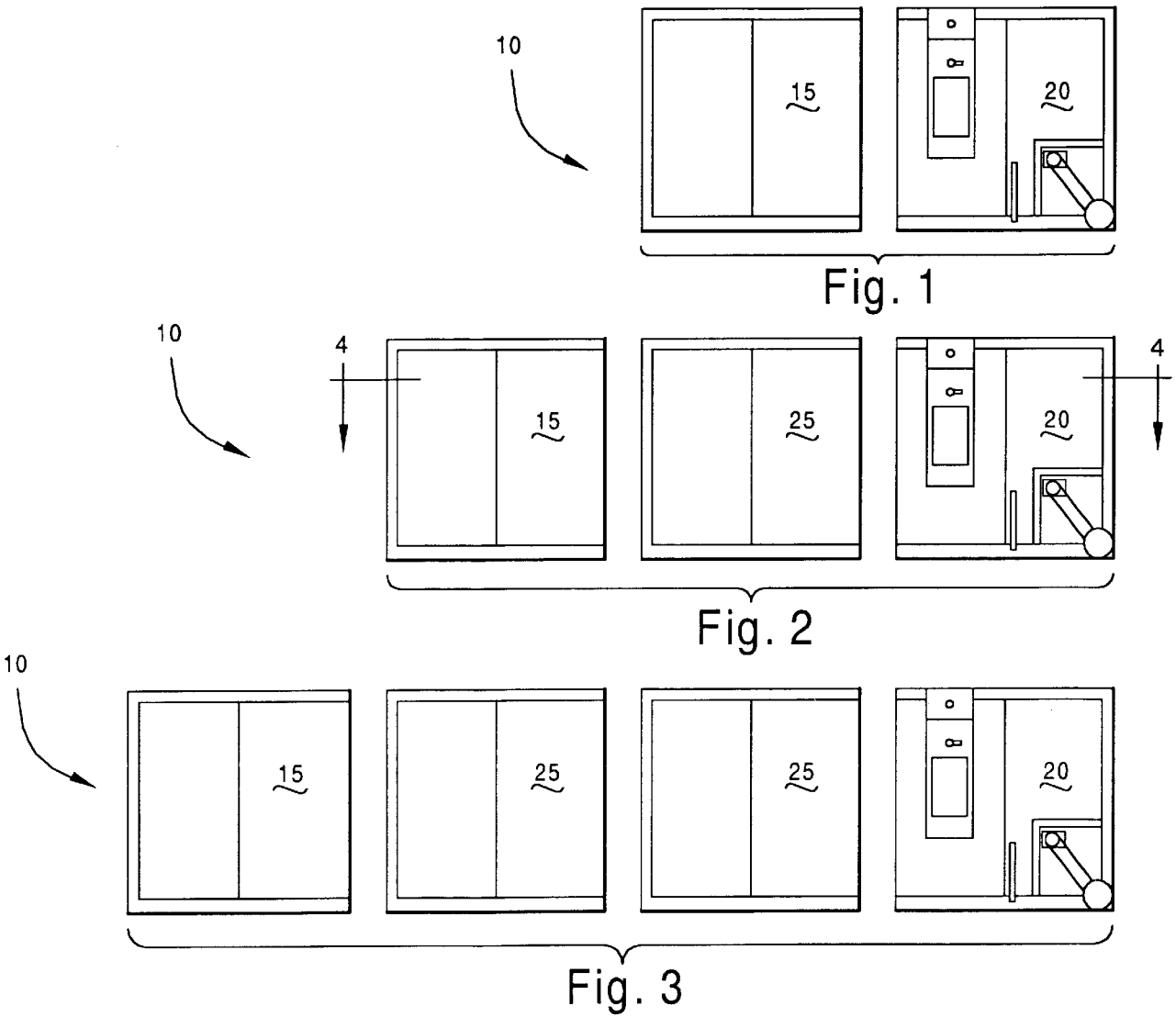
FIG. 1 is a side elevation of a U-turn finisher according to a preferred embodiment of the invention.
FIG. 2 is a side elevation of a U-turn finisher with a single expansion module according to a preferred embodiment of the invention.
FIG. 3 is a side elevation of a U-turn finisher with two expansion modules according to a preferred embodiment of the invention.

Referring now specifically to the drawings, a U-turn finisher according to the present invention is illustrated in FIGS. 1, 2, 3 and 4 and shown generally at reference numeral 10. The principle of the invention resides in the construction of three distinct modules—a front module 15, a rear module 20 and an expansion module 25.

Figure 4:
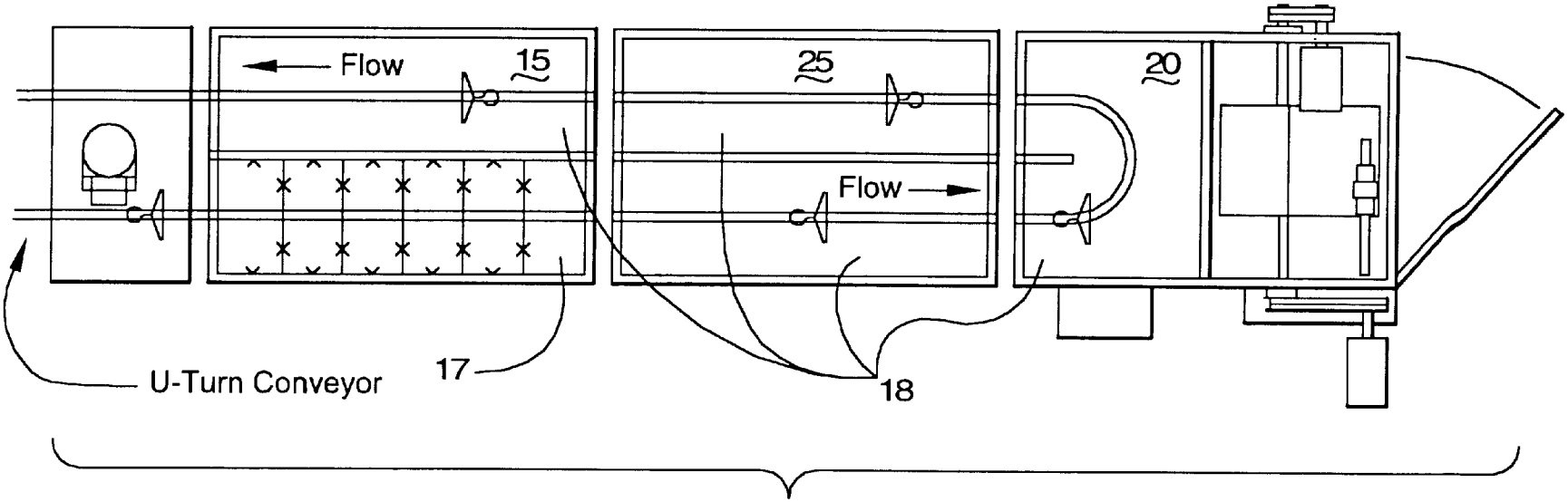
FIG. 4 is a horizontal cross-section of the U-turn finisher taken through line 4—4 of FIG. 2.

The front module 15 contains the entrance to and exit from the finisher 10 through which the garments are conveyed on hangers into and conveyed out of the finisher 10. As shown in FIG. 4, the entrance side of the front module 15 comprises a steaming zone 17 where live steam is injected into the garment immediately after it enters the finisher 10. The exit side of the front module 15 comprises a hot air zone 18 where air from a hot air plenum is directed down through the moving garments to complete the drying process. An exhaust hood is also carried by the front module 15 for exhausting moisture-laden air from the finisher 10.

As shown in FIG. 1, the rear module 20 is bolted in line to the front module 15. The rear module 20 contains the heat source, which may be a steam heat exchanger, electric heating coils, or one or more gas burners. In addition, the rear module 20 contains a blower for circulating hot air through the entire finisher 10, electrical controls, including thermostats, for controlling temperature, and a main operator control panel.

As is best shown in FIG. 4, garments are carried on hangers by a chain conveyor from the steaming zone 17 through the rear module 20 where the conveyor makes a U-turn, delivering the garments into the hot air zone 18 and out of the exit of the finisher 10 in the front module 15. The hot air zone begins directly after steaming and continues around the entire machine.

The front module 15 and rear module 20 collectively comprise an entire functioning finisher 10, and so long as production capacity is met, need not be changed. However, an increase in production can be easily and inexpensively met by unbolting the front module 15 from the rear module 20, spreading them apart and inserting in-line between them an expansion module 25, as shown in FIGS. 2 and 4. The expansion module 25 contains only an airflow plenum needed to direct heated air onto the garments. The conveyor chain and piping are lengthened to accommodate the new, longer length, and the system is complete. The simple construction of the expansion module 25 and the lack of need for other functional components provides a very inexpensive way of increasing production. There is no need for additional electronics, heating capacity or blowers. Furthermore, the expansion modules may be manufactured in various lengths according to customer specifications.

As is shown in FIG. 3, a pair of expansion modules 25 can be added end-to-end in-line with front module 15 and rear module 20 for further increases in productivity.

As noted above, garment finishing takes place by exposing the garments to live steam and an quantity of heat sufficient to raise the temperature of the garment and evaporate the remaining moisture. This is not a function of distance traveled in the finisher 10, but the amount of time the garment is exposed to the heated air. Operation of the finisher 10 in its expanded condition results in greater production by increasing the rate of travel of the garments and increasing the length of the path of travel of the garment in the finisher so that the time in the finisher remains the same. For example, if the finisher 10 in FIG. 1 is able to finish a garment in five minutes, doubling both the rate of travel of the garment through the finisher 10 and doubling the length of the path of the garment through the finisher 10 results in an equal amount of drying time but at a much greater production rate. Thus, upon installation of one or more of the expansion modules 25, the speed of the conveyor is increased so that the amount of time the garment remains in the finisher 10 is the approximately the same. While minor adjustments in air flow velocities and other operating parameters may be necessary in a given case, these are easily determined by trial-and-error.

Specifications for finishers according to the invention are set out below:

| MODEL | 16 SH | 16 GH | 24 GH | 32 GH |
|---|---|---|---|---|
| MACHINE SIZE (exclusive of conveyor system) | | | | |
| Length (mm) | 192" (4877) | l92" (4877) | 288" (7315) | 384" (14,630) |
| Width (add l2" for control box)(mm) | 60" (l524) | 60" (l524) | 60" (l524) | 60" (1524) |
| Height (mm) | 90" (2286) | 90" (2286) | 90" (2286) | 90" (2286) |
| ELEC-TRICAL SERVICE | | | | |
| Standard | | 220 volts 60 cycle 3 phase | | |
| For other voltages contact factory | | | | |
| Nameplate Amps | 33 | 38 | 48 | 65 |

-continued

| MODEL | 16 SH | 16 GH | 24 GH | 32 GH |
|---|---|---|---|---|
| STEAM REQUIREMENTS | | | | |
| Bhp Average (Kg/hr) | 30 (525) | 15 (265) | 15 (265) | 15 (265) |
| Steam Line | 2" | 1" | 1" | |
| Return Line | 1½" | ½" | ½" | ½" |
| Maximum Pressure (atm) | | | 125 PSI (9) | |
| GAS REQUIREMENTS | | | | |
| Gas Line | | 2" | 2" | 2" |
| Operation Gas Pressure (w.c.) | | 8–16" w.c. | 8–16" w.c. | 8–16" w.c. |
| Operation Gas Pressure (millibar) | | 24–40 mbar | 24–40 mbar | 24–40 mbar |
| Burner Rating BTU | | 800,000 | 800,000 | 1,200,000 |
| Average Usage BTU | | 365,000 | 475,000 | 750,000 |
| Average Usage Watts | | 110,000 | 140,000 | 220,000 |
| VENTILATION REQUIREMENTS | | | | |
| Exhaust Duct Size (mm) | 12" (305) | 12" (305) | 12" (305) | 12" (305) |

A tunnel finisher is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An expandable tunnel garment finishing apparatus, comprising:

(a) a front module having an entrance for receiving garments on hangers for being conveyed through the apparatus, an initial treatment zone downstream from the entrance for treating the garments with steam and heat, a final treatment zone downstream from the initial treatment zone for treating the garments with hot air, and an exit downstream from the final treatment zone and adjacent the entrance through which the finished garments exit the finishing apparatus;

(b) a rear module communicating with the front module for receiving garments conveyed therefrom, said rear module including a heating apparatus for heating the garments, and a U-shaped intermediate treatment zone downstream from the initial treatment zone and upstream from the final treatment zone for receiving the garments from the initial treatment zone and for delivering the garments to the final treatment zone and the exit of the front module; and (c) said front and rear module being separable for receiving therebetween at least one expansion module comprising an expansion treatment zone cooperating with the initial, intermediate, and final treatment zones for providing the garment finishing apparatus with an extended total treatment zone sufficient to permit accelerated flow of the garments through the finishing apparatus while maintaining sufficient dwell time of the garments in the finishing apparatus to permit completed finishing at the accelerated rate of flow of the garments.

2. A finishing apparatus according to claim 1, wherein said finishing apparatus has a total length of 192 inches.

3. A finishing apparatus according to claim 2, wherein said finishing apparatus has a total length of 288 inches.

4. A finishing apparatus according to claim 2, wherein said heating apparatus has a burner rating of 800,000 BTU.

5. A finishing apparatus according to claim 4, wherein said finishing apparatus has a total length of 384 inches.

6. A finishing apparatus according to claim 4, wherein said heating apparatus has a burner rating of 1,200,000 BTU.

7. A finishing apparatus according to claim 1, wherein said finishing apparatus includes one expansion module positioned intermediate the front module and the rear module for providing the garment finishing apparatus with an extended total treatment zone sufficient to permit accelerated flow of the garments through the finishing apparatus while maintaining sufficient dwell time of the garments in the finishing apparatus to permit completed finishing at the accelerated rate of flow of the garments.

8. A finishing apparatus according to claim 1, wherein said finishing apparatus includes two adjacent, detachably connected expansion modules positioned intermediate the front module and the rear module to further extend the total treatment zone for maximum accelerated flow of the garments through the finishing apparatus while maintaining sufficient dwell time of the garments in the finishing apparatus to permit completed finishing at the maximum rate of flow of the garments.

* * * * *